US005894978A

United States Patent [19]

Welch et al.

[11] Patent Number: 5,894,978

[45] Date of Patent: Apr. 20, 1999

[54] FLEXIBLE MATERIAL CUTTER

[75] Inventors: Jeffrey M. Welch, 4301 Zealand Ave. North, New Hope, Minn. 55428; Brian K. Balzum, Plymouth, Minn.

[73] Assignee: Jeffrey M. Welch, New Hope, Minn.

[21] Appl. No.: 08/884,310

[22] Filed: Jun. 27, 1997

[51] Int. Cl.[6] ..... B26D 1/03; B26D 7/26; B26F 3/02

[52] U.S. Cl. ..... 225/7; 83/408; 83/425.4; 83/436.5; 83/468; 83/468.6; 83/522.19; 83/564; 83/649; 225/18

[58] Field of Search ..... 83/408, 425.4, 83/436.5, 436.55, 468, 468.6, 468.7, 522.16, 522.19, 544, 649, 564; 225/7, 18

[56] References Cited

U.S. PATENT DOCUMENTS

| | | | |
|---|---|---|---|
| 909,854 | 1/1909 | Denison . | |
| 1,541,505 | 6/1925 | Hurley . | |
| 2,035,946 | 3/1936 | Cummings | 83/408 |
| 2,447,145 | 8/1948 | Van Cleef et al. . | |
| 2,645,543 | 7/1953 | Mancini | 83/649 X |
| 2,747,664 | 5/1956 | Corson | 83/408 |
| 2,788,852 | 4/1957 | Sharpe | 225/7 |
| 3,160,047 | 12/1964 | Malloy et al. | 83/436.5 X |
| 3,176,572 | 4/1965 | Comet | 83/522.19 X |
| 3,296,911 | 1/1967 | McLane | 83/408 |
| 3,788,175 | 1/1974 | Davis | 83/649 X |
| 3,935,776 | 2/1976 | Dingus . | |
| 3,971,279 | 7/1976 | Wright . | |
| 4,455,905 | 6/1984 | Raymond | 83/436.5 X |
| 4,827,818 | 5/1989 | Stringfellow . | |
| 5,025,692 | 6/1991 | Reynolds | 83/408 X |
| 5,103,710 | 4/1992 | Ross | 83/649 X |

FOREIGN PATENT DOCUMENTS

| | | | |
|---|---|---|---|
| 720839 | 12/1954 | United Kingdom | 225/18 |

*Primary Examiner*—Eugenia A. Jones
*Attorney, Agent, or Firm*—James W. Miller

[57] ABSTRACT

A cutter for cutting flexible material held on a roll thereof. The cutter has a frame that mounts a drop in roll of flexible material and a drop in tensioning roller in an open end of the frame. The cutter has a cutting area that is generally enclosed and houses a plurality of slitting knives and a tear off cutting blade. The cutting area has an entrance and exit slot for the material with the slitting knives slitting the material as it passes through the cutting area. The slit material can exit through the exit slot. After a predetermined length has been pulled forwardly relative to the cutting blade the slit material can be cut into pieces by tearing it against the cutting blade. A length determining gage allows pieces of a precise length to be cut. The material is pulled through the cutter by a set of feed rollers contained within the cutting area.

16 Claims, 3 Drawing Sheets

FLEXIBLE MATERIAL CUTTER

TECHNICAL FIELD

This invention relates to a cutter for slitting flexible material as the material is pulled off from a roll of such material and for thereafter cutting to length the strips of flexible material formed by the slitting operation. More particularly, the cutter of this invention is particularly useful for quickly, easily and safely cutting embroidery backing material or other flexible material into pieces of any desired size.

BACKGROUND OF THE INVENTION

In the embroidery field, a backing material made from a flexible felt or fabric type material is used on the back of the item being embroidered to receive the stitching. The size of the required piece of backing material varies depending on the size of the area receiving the embroidery. The user must cut a piece of backing material of approximately the right size and use it behind the area being embroidered. Thus, there is often a need in this field, as in many others, to cut a square or rectangular piece of material from a bolt or roll of such material.

Prior to this invention, the typical way of cutting a piece of backing material was to pull the material off the roll by hand and to then use a pair of scissors to manually cut the material both widthwise and lengthwise. While effective, this method was time consuming and clumsy. It is difficult to precisely cut the material using only scissors. It is difficult to accurately measure the material before cutting.

Various machines are known from various fields for slitting material provided on rolls. For example, U.S. Pat. No. 4,827,818 to Stringfellow discloses a machine for slitting felt used as a roofing material. U.S. Pat. No. 3,971, 279 to Wright shows a machine for slitting columns of printed text from a roll of paper to use the text columns to paste up a page of newsprint. Wright includes a fixed cutting blade or bar for tearing off the paper at the end of the text columns.

Slitting and cutting machines such as Wright have various disadvantages. For example, they are generally hard to use and adjust. They have no provision for easily and accurately setting or adjusting the slitting knives or for measuring the width and length of the cut pieces. Accordingly, they would not be particularly usefully for cutting pieces of embroidery material, or similar flexible material, where one need is for simplicity and ease of use and another need is for accurately cut pieces of material.

SUMMARY OF THE INVENTION

One aspect of this invention relates to a cutter for cutting pieces of flexible material from a roll of flexible material. The cutter comprises a frame having means for rotatably supporting a roll of the flexible material on the frame such that the flexible material can be pulled off and unwound from the roil. A cutting area on the frame carries cutting elements including at least one slitting knife which is arranged longitudinally relative to the flexible material to slit the material lengthwise as the material is pulled past the at least one slitting knife. The cutting elements further include a transverse cutting blade for cutting the material into pieces after the material has been slit by the at least one slitting knife. A length determining gage is also provided for setting the length of the cut pieces.

Another aspect of this invention relates to a cutter for cutting pieces of flexible material from a roll of such material which includes a frame having a generally enclosed end and an end that is upwardly open. A roll of flexible material is rotatably carried on the open end of the frame. A plurality of slitting knives are contained in the enclosed end of the frame beneath a top wall thereof and capable of being set at different spacings across the enclosed end of the frame such that the user is protected from contact with the slitting knives. The slitting knives are arranged longitudinally relative to the flexible material for slitting the material as it is pulled off from the roll thereof.

An additional aspect of this invention relates to a cutter of the type set forth above having a frame including spaced side walls connected together at one end by a front wall and a top wall to form a generally enclosed end of the frame. A means is provided for rotatably supporting a roll of the flexible material on the side walls of the frame outside the enclosed end of the frame. A slot is provided in the front wall of the frame for allowing the flexible material to be pulled off the roll through the enclosed end of the frame and to exit the enclosed end of the frame through the slot. A set of feed rollers is provided within the enclosed area of the frame for feeding material from the roll through the enclosed area of the frame and out through the slot. A plurality of slitting knives is mounted within the enclosed area of the frame for slitting the material passing therethrough. A fixed tear off blade is mounted on the frame against which the slit material that has exited through the slot can be torn to sever the slit material into separate pieces.

BRIEF DESCRIPTION OF THE DRAWINGS

This invention will be described more completely in the following Detailed Description, when taken in conjunction with the following drawings, in which like reference numerals refer to like elements throughout.

DETAILED DESCRIPTION

Figure 1:
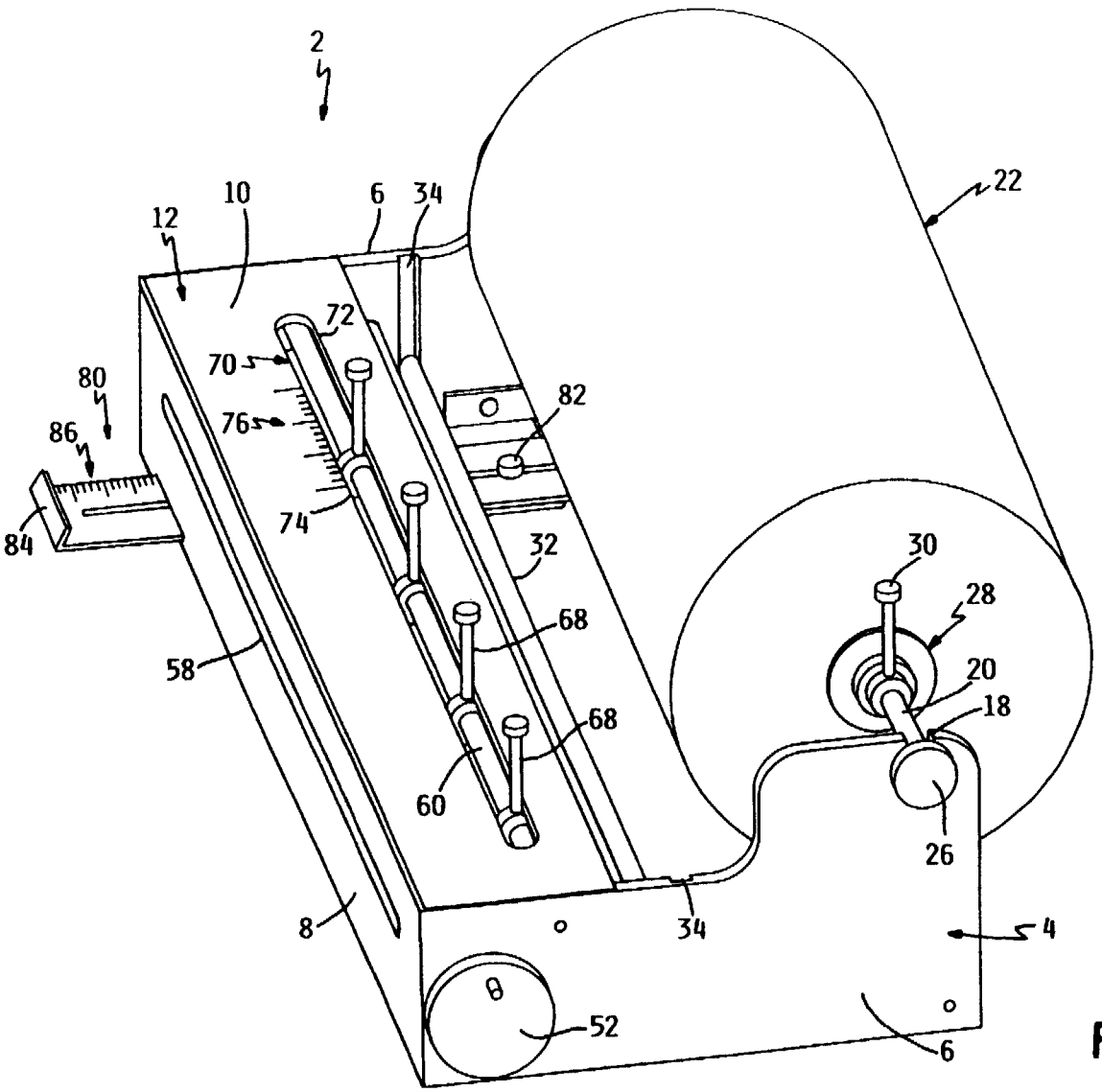
FIG. 1 is a perspective view of a cutter according to this invention, showing a flexible material roll having been installed on the cutter but prior to the flexible material on the flexible material roll having been threaded through the enclosed end of the frame in which the various cutting elements are housed.
Figure 2:
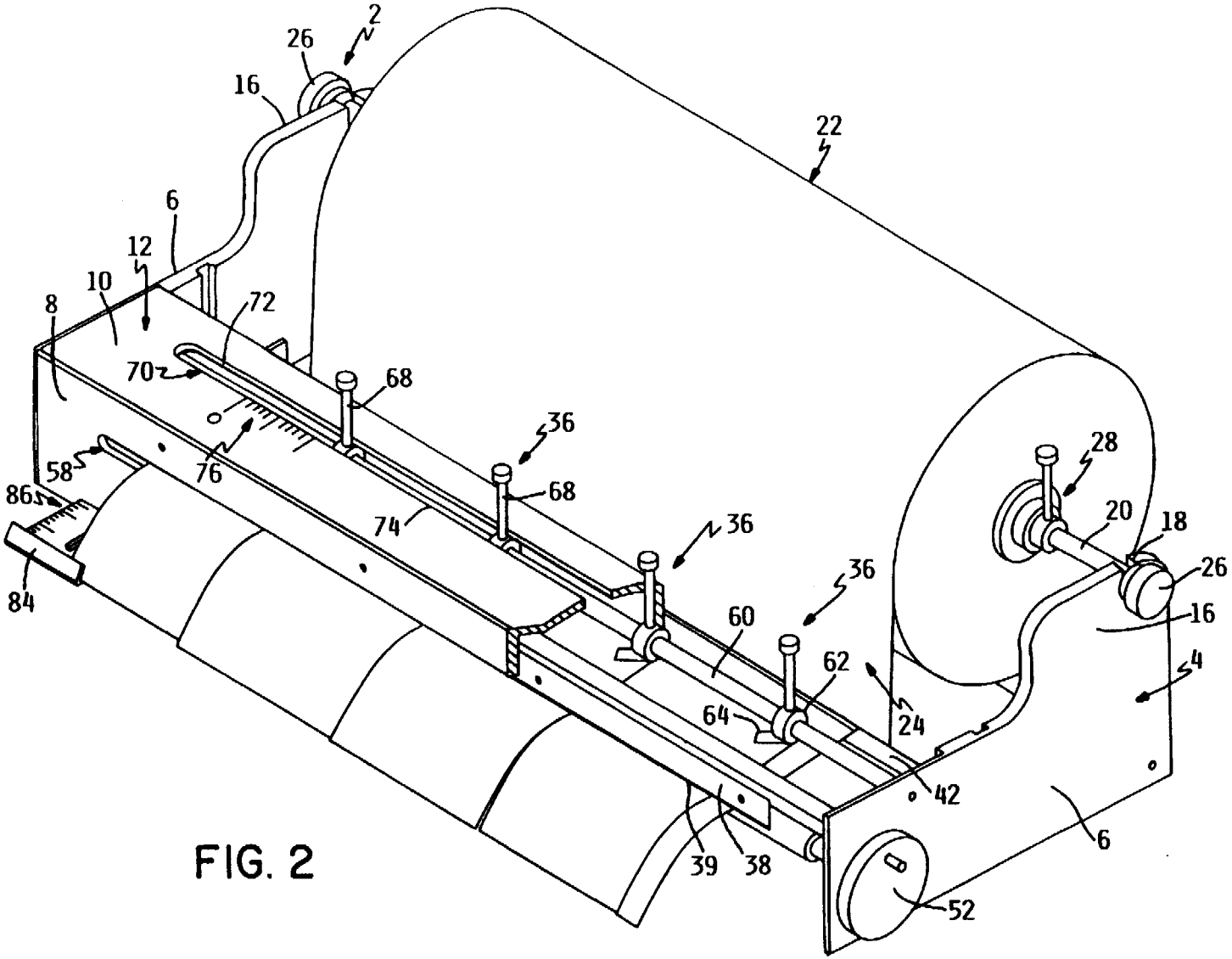
FIG. 2 is a perspective view of the cutter of FIG. 1, showing a flexible material roll having been installed on the cutter and the flexible material on the flexible material roll having been threaded through the enclosed end of the frame with the flexible material having been slit, a portion of FIG. 1 being broken away to show some of the slitting knives.
Figure 3:
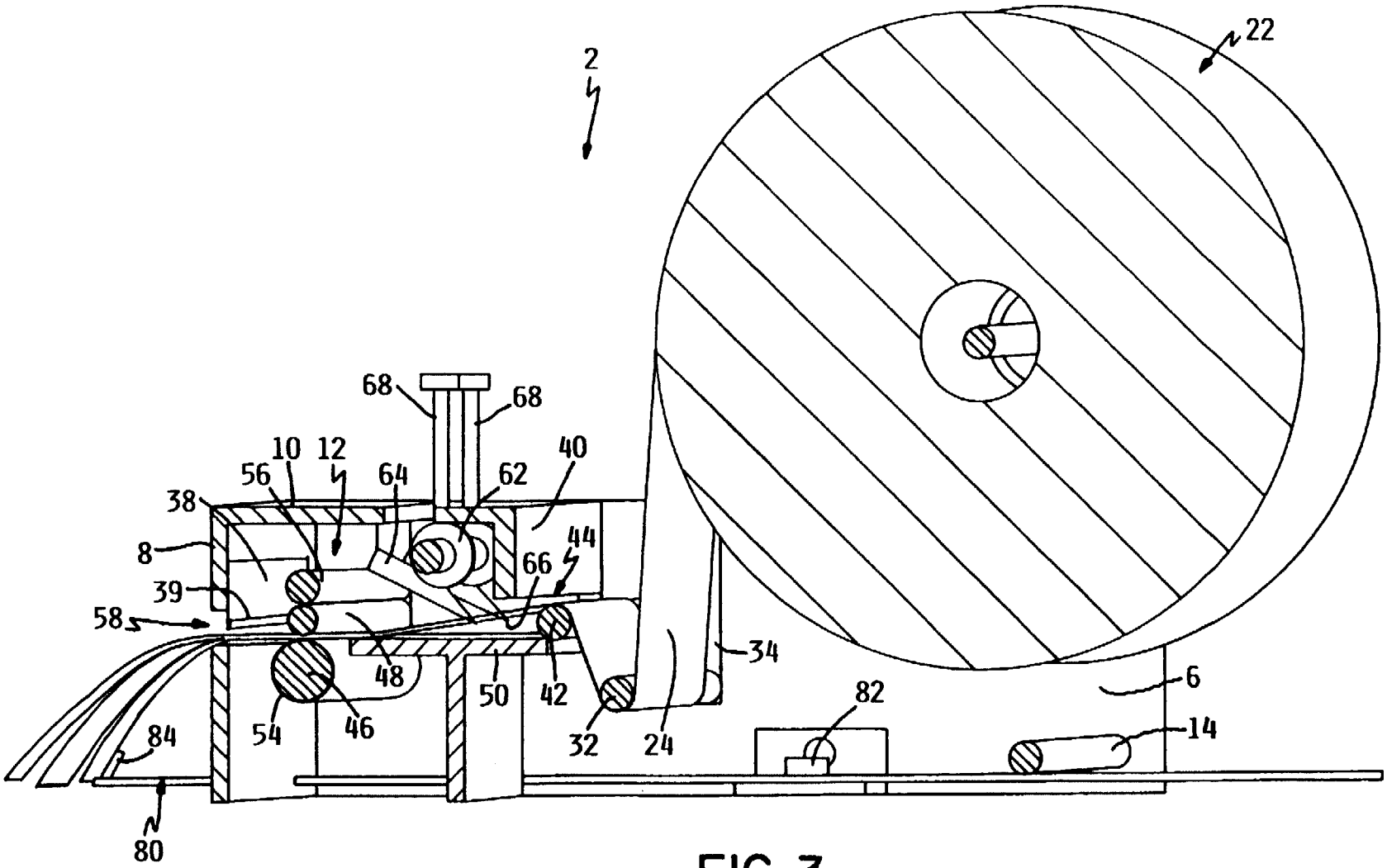
FIG. 3 is a cross-sectional side-elevational view of the cutter shown in FIG. 1.

The cutter 2 of this invention includes a frame 4 having spaced, parallel side walls 6 connected together by a front wall 8. A top wall 10 extends between and also connects side walls 6 adjacent front wall 8. Collectively, front wall 8, top wall 10, and the forward portions of side walls 6 define a generally enclosed front end 12 of frame 4. The remaining portion of frame 4 to the rear of top wall 10 is generally open from above, i.e. there is no other top wall bridging side walls 6 in this portion of frame 4. Cross-members 14 can be used as needed to extend between side walls 6 in this open portion of frame 4 to provide sufficient strength and rigidity to frame 4.

The rear ends of side walls 6 have upwardly projecting ears 16 which are slotted at 18 along their upper edges. A through shaft 20 can be dropped into place into the upwardly facing slots 18 with through shaft 20 rotatably carrying a roll 22 of flexible material 24 thereon. The outer portions of through shaft 20 are threaded and carry threaded knobs 26 that can be tightened against side walls 6 to hold through shaft 20 in place. Two slidable bushings 28, only one of which is shown in the drawings, can be spaced apart and fixed in place on through shaft 20 to rotatably hold flexible material roll 22 between bushings 28.

The use of upwardly protruded ears 16 on side walls 6 allows a fairly large flexible material roll 22 to be carried on frame 4. Typically, flexible material rolls 22 have an 4' to 20' diameter, but flexible material rolls 22 may be larger, i.e. up to approximately 30' or so. Flexible material rolls 22 can vary in width as well. The maximum width that can be accommodated is limited only by the distance between side walls 6 and the space taken up by bushings 28. Flexible material rolls 22 can be several feet wide.

Flexible material rolls 22 can be easily and quickly installed on frame 4. To install a new flexible material roll 22, the user simply loosens knobs 26 and lifts through shaft 20 up out of slots 18 at the top of ears 16 in side walls 6. One bushing 28 is then slid completely off through shaft 20. Flexible material roll 22 is then slid onto through shaft 20 until it abuts against the bushing 28 that was left on through shaft 20.

The process is then reversed. The bushing 28 that was removed is replaced on through shaft 20 by sliding it down through shaft 20 until it abuts against the end of flexible material roll 22. This bushing 28 can be fixed in this location by tightening a set screw or the like on through shaft 20 using an elongated handle 30. Through shaft 20 with the new flexible material roll 22 in place thereon is then lifted and dropped back down into slots 18 at the top of the side wall ears 16. Knobs 26 are then tightened in place against side walls 6. Thus, flexible material roll 22 is now rotatably secured on through shaft 20 with the core of flexible material roll 22 rotating around through shaft 20 as material 24 is pulled off roll 22.

A flexible material tensioning roller 32 is carried on frame 4 forwardly of flexible material roll 22 but still within the area of frame 4 that is open from above. Two vertical slots 34 are placed on the inside surface of side walls 6 in alignment with one another for rotatably receiving each end of roller 32. Tensioning roller 32 can be easily and quickly installed in frame 4 by dropping the ends thereof down into slots 34 after some flexible material 24 is pulled off flexible material roll 22 and threaded through enclosed end 12 of frame 4.

The purpose of tensioning roller 32 is to create sufficient tension on flexible material 24 as it passes from roll 22 through enclosed end 12 of frame 4 to allow flexible material 24 to be properly slit and cut. However, roller 32 is not permanently part of frame 4, but can be dropped into frame 4 from above after flexible material 24 has been threaded through enclosed end 12 of frame 4. Thus, tensioning roller 32 is not in the way during the material threading process. This allows flexible material 24 to be drawn off flexible material roll 22 and threaded through enclosed end 12 of frame 4 in a generally straight path. This greatly eases the threading of material 24 through frame 4.

Enclosed end 12 of frame 4 is sufficiently enclosed and covered to prevent the user from inadvertently contacting the cutting elements that are housed within enclosed end 12. There are two types of cutting elements used within enclosed end 12 of frame 4. The first is a slitting knife 36 that is oriented longitudinally relative to flexible material 24 coming off flexible material roll 22 so as to slit flexible material 24 lengthwise as it passes past knife 36. The second cutting element is a fixed, transversely extending tear off blade 38 against which flexible material 24 can be pulled to cut flexible material 24 to length by severing flexible material 24 across its width. Both slitting knives 36 and tear off blade 38 are located within generally enclosed end 12 of frame 4 covered by top wall 10 and front wall 8 of frame 4.

Enclosed end 12 of frame 4 has a rear wall 40 that extends downwardly a short distance from top wall 10. A fixed bearing surface formed by the top of a fixed guide roller 42 is spaced from the lower edge of rear wall 40 by a small gap to form an entrance slot 44 into enclosed end 12 of frame 4. Flexible material 24 is threaded through this slot 44 above guide roller 42 and beneath rear wall 40 after it is pulled off flexible material roll 22. Flexible material 24 then passes in a slight downward inclination in a straight line through a set of feed rollers 46 and 48 carried in frame 4. A horizontal shelf 50 is provided between feed rollers 46 and 48 and guide roller 42 to help flexible material 24 travel into the pinch point of feed rollers 46 and 48 as flexible material 24 is being threaded through enclosed end 12 of frame 4.

Feed rollers 46 and 48 include a larger bottom feed roller 46 and a smaller top feed roller 48. Both feed rollers 46 and 48 are rotatably journalled between side walls 6 of frame 4 so as to be rotatable on frame 4. The pivot shaft or axle of lower feed roller 46 extends outwardly through one side wall 6 of frame 4. A circular knob or handle 52 is provided on the outwardly extended portion of the axle of feed roller 46 outside side wall 6. Knob or handle 52 can be gripped by the user to manually rotate lower feed roller 46. Manual rotation of knob or handle 52 causes feed rollers 46 and 48 to grip and pull flexible material 24 off flexible material roll 22 and through frame 4.

Feed rollers 46 and 48 are preferably provided with an outer covering 54 that is textured and has sufficient friction for material 24 being fed from flexible material roll 22. When that material comprises a typical embroidery backing material, the Applicants have found it advantageous to cover feed rollers 46 and 48 with a sticky tape manufactured by MMM Co. known as SAFETY WALK TAPE®. Such a tape covering 54 for feed rollers 46 and 48 will smoothly grip and pull embroidery backing material through frame 4 in a reliable manner. However, depending upon the nature of flexible material 24 being carried on flexible material roll 22, the nature of the outer covering 54 of feed rollers 46 and 48 could be changed or the outer covering 54 might even be dispensed with such that only rubber feed rollers are used.

Top feed roller 48 needs to engage bottom feed roller 46 with sufficient force so that it rests firmly in engagement with bottom feed roller 46 during a feeding operation. An additional weighted roller 56 is placed in engagement with top feed roller 48 to add additional weight thereto.

From feed rollers 46 and 48, material 24 passes further forwardly for a short distance until it passes through an exit slot 58 of enclosed end 12 of frame 4. Exit slot 58 extends horizontally across front wall 8 from a position adjacent one side wall 6 to a position adjacent the other side wall 6. Tear off blade 38 is located on the back side of front wall 8 with its sharpened cutting edge 39 protruding slightly into slot 58. Preferably, to further enhance safety, tear off blade 38 is located on the back side of front wall 8 above the slot with its sharpened lower edge 39 facing downwardly relative to slot 58. The user simply pulls up on material 24 to cut or tear it off against blade 38.

A plurality of slitting knives 36 are carried in enclosed end 12 of frame 4 on a support rod 60 located slightly beneath top wall 10 of frame 4. Each knife 36 includes a circular hub 62 received on rod 60. A sharpened razor or EXACTO® type blade 64 is carried on a lower portion of the hub to be oriented longitudinally relative to flexible material 24.

Each slitting knife 36 can be slid along the length of rod 60 to adjust its widthwise position above flexible material 24, i.e. to control the width of the slit portions of flexible material 24. Each knife 36 is also angularly rotatable about rod 60 to move knife 36 between a lowered working position where the tip 66 of knife blade 64 protrudes into flexible material 24 and a raised inoperative position where tip 66 of knife blade 64 is rotated up out of engagement with flexible material 24. A rotatable set screw having an elongated, upwardly extending handle 68 is provided in hub 62 of each slitting knife 36 to lock knife 36 in an adjusted position along rod 60.

Because slitting knives 36 are desirably enclosed and protected by enclosed end 12 of frame 4, a transverse slot 70 is provided in top wall 10 of frame 4 extending most of the way between side walls 6 of frame 4. Top slot 70 is similar in size to front slot 58. Each of the set screw handles 68 for the set screws used to fix slitting knives 36 in place extend upwardly through top slot 70 with their upper ends located outside of enclosed end 12 of frame 4. This allows the user to conveniently adjust slitting knives 36, both angularly as well as along the axis of rod 60, from outside enclosed end 12 of frame 4, even though slitting knives 36 themselves are protected within enclosed end 12 of frame 4. This greatly eases the task of adjusting slitting knives 36 and makes cutter 2 of this invention much more user friendly than prior art devices.

In using upwardly extending handles 68 on slitting knives 36, each handle 68 can be rotated about its axis to tighten or loosen the set screw (not shown) that holds knife 36 to support rod 60. If the set screw is loosened, knife 36 can be slid along rod 60. In addition, the user can use handle 68 to conveniently pivot knife 36 between its working and inoperative positions. This is done simply by pulling handles 68 forwardly or rearwardly in top slot 70.

In this regard, the components are configured so that the leading edge 72 of top slot 70 serves as a stop that defines the working position of the knives and the trailing edge 74 of top slot 70 serves as a stop that defines the in-operative position of the knives, the adjectives leading and trailing taken with reference to the forward direction of flexible material 24 through frame 4. In other words, if handle 68 is allowed to rest against leading edge 72 of top slot 70, then knife blade 64 has been rotated down into its lower working position. Similarly, if the user pulls back on handle 68 until handle 68 rests against trailing edge 74 of top slot 70, knife 36 has been rotated around rod 60 until it is no longer in the path of flexible material 24. Knife 36 will rest on its own in either position without having to tighten the set screw. Handle 68 needs to be tightened to lock knife 36 in place only against movement along the axis of rod 60, i.e. to lock knife 36 in place at a particular widthwise position across flexible material 24.

A width scale 76 for setting the widthwise location of slitting knives 36 is provided adjacent top slot 70. Scale 76 has a zero mark at or adjacent one end of slot 70 and increases to its maximum value at the other end of slot 70. Preferably, one bushing 28 on through shaft 20 is aligned with the zero mark of scale 76 and is left permanently in place in this position, perhaps even being permanently fixed to through shaft 20 in this position. Thus, when flexible material roll 22 is placed within frame 4, one edge thereof will be aligned with the zero mark of width scale 70.

Width scale 70 allows the user to conveniently and accurately set slitting knives 36 along the axis of rod 60 to precise values. For example, if the user desires a first strip of material six inches wide, a second strip four inches wide, and a third strip two inches wide, the user can set the first knife at six inches from the zero mark, the second knife at 10 inches from the zero mark, and the third knife at twelve inches from the zero mark. Then, when material 24 passes past slitting knives 36 with these knives being in their lowered working positions, material 24 will be slit with the first three strips having widths of six, four and two inches, respectively. These strips of material will pass outwardly through front slot 58 where they can be torn or cut off against tear off blade 38 carried on the back side of front wall 8 by pulling up on the strips.

Frame 4 includes an adjustable length determining gage or stop 80 that is slidable on frame 4 and can be fixed in an adjusted position by clamping nut 82. Length determining gage 80 has an upwardly extending front end 84 that is bent back at a slight angle to allow the front edge of flexible material 24 being pulled off flexible material roll 22 to be abutted against the front end 84 of gage 80 at the junction between the front end 84 of gage 80 and the body of gage 80. Gage 80 can be pulled outwardly or pushed rearwardly on frame 4 to control how far in front of tear off blade 38 front end 84 of gage 80 is located.

Preferably, gage 80 includes a length scale 86 that can be read against the front face of front wall 8 to determine the length of material 24 being severed by tear off blade 38. Length scale 86 is calibrated relative to the position of tear off blade 38 and the geometry of front slot 58 relative to the position of gage 80 so that the length of material 24 being torn or severed by blade 38 can be read. For example, if gage 80 is set to 10 against front wall 8 of frame 4, then a 10 inch long strip of material will be cut off when flexible material 24 is pulled up against blade 38 after first being engaged with front end 84 of gage 80.

Cutter 2 of this invention is simple and durable, yet easy to use and operate. A new roll 22 of flexible material 24 can be easily installed on frame 4 from above by dropping roll 22 down into frame 4 as described earlier. Then, with slitting knives 36 being disposed in their inoperative positions with their handles 68 in engagement with trailing edge 74 of top slot 70, the user can pull material 24 off roll 22 and thread it through entrance slot 44 of enclosed end 12 of frame 4, over fixed guide roller 42, and then on over shelf 50 and between feed rollers 46 and 48. The user can then rotate feed rollers 46 and 48 by hand to pull material 24 through frame 4 with the front end of material 24 then passing on outwardly through front slot 58 of frame 4. This would complete the threading of flexible material 24 from flexible material roll 22 through enclosed end 12 of frame 4.

Once the threading is complete, the user can easily drop tensioning roller 32 down into the open portion of frame 4 from above to put proper tension on flexible material 24 within the cutting area. The user can then set as many slitting knives 36 as is desired in a working position at a particular widthwise location along rod 60 simply by pushing forwardly on handles 68 of those knives until those handles engage leading edge 72 of top slot 70. In this position, knife blade 64 of each knife 36 so set will pierce or penetrate down through the plane of flexible material 24 as it passes from guide roller 42 towards feed rollers 46 and 48. Handles 68 can be moved sidewardly along rod 60 to position the knives 36 at a particular width. Handles 68 can then be rotated to engage the set screw at the lower end of handles 68 with rod 60 to lock slitting knives 36 in place.

With slitting knives 36 set to cut strips of desired widths, the length gage 80 can be set, if desired, to cut strips of desired lengths. Then, to operate cutter 2, the user simply manually rotates feed rollers 46 and 48 using handle 52 until front end 84 of flexible material 24 drops down into engagement with front end 84 of gage 80. If the user then pulls up on flexible material 24 to tear flexible material 24 off against tear off blade 38, the user will wind up with various strips of flexible material in a length determined by the position of gage 80 and in the various widths determined by the position of slitting knives 36. This slitting and cutting operation can be quickly and easily done and provides pieces of material that are precisely cut to desired length and width.

Cutter 2 of this invention is simple to thread and easy to use. Feed rollers 46 and 48 can be easily rotated by hand to pull material 24 through cutter 2. Length gage 80 and slitting knives 36 are easy to set and adjust to provide pieces of cut material having the right length and width. However, the cutting elements of cutter 2 are enclosed and protected within enclosed end 12 of frame 4 to provide safe operation.

Various modifications of this invention will be apparent to those skilled in the art. For example, while feed rollers 46 and 48 have been described as being manually operated, they could be motor driven if so desired. Thus, the scope of the invention shall be limited only by the appended claims.

We claim:

1. A cutter for cutting pieces of flexible material from a roll of flexible material, which comprises:

(a) a frame having means for rotatably supporting a roll of the flexible material on the frame such that the flexible material can be pulled off and unwound from the roll, the frame further having a pair of rotatable feed rollers for pulling the material off the roll and feeding the material through the frame, at least one of the feed rollers having a sticky outer surface that is able to grip and pull the material;

(b) a cutting area on the frame for carrying cutting elements comprising:

(i) at least one slitting knife which is arranged longitudinally relative to the flexible material to slit the material lengthwise as the material is pulled past the at least one slitting knife;

(c) wherein the cutting area of the frame includes spaced side walls connected at one end to a front wall and a top wall, the side walls, top wall and front wall of the frame forming the cutting area of the frame, wherein the at least one slitting knife is substantially enclosed inside the cutting area of the frame and is carried inside the cutting area beneath the top wall thereof, and wherein a top slot is carried in the top wall of the frame with the top slot extending across the top wall between the side walls of the frame; and (d) wherein the at least one slitting knife has means for adjusting the at least one slitting knife inside the cutting area from above the frame, wherein the knife adjusting means comprises a handle on each slitting knife protruding upwardly through the top slot to allow each slitting knife to be moved transversely and angularly within the cutting area.

2. The cutter of claim 1, wherein each knife has a hub which is angularly and slidably carried on a transverse support rod within the cutting area, and wherein leading and trailing edges of the top slot are configured relative to the knife and the handle thereof to provide stops which limit the angular adjustment of the knife to a working position in which a tip of the knife is within the plane of the flexible material passing through the cutting area to an in-operative position in which the knife tip is up out of the plane of the flexible material.

3. The cutter of claim 2, wherein the handle is operatively connected to a set screw such that rotation of the handle about its axis further locks the knife to the transverse support rod.

4. The cutter of claim 1, wherein the cutting elements further comprise a transverse cutting blade for cutting the material into pieces after the material has been slit by the at least one slitting knife, and further including a length determining gage for setting the length of the cut pieces.

5. The cutter of claim 4, wherein the length determining gage includes an upwardly raised portion against which a front end of the slit material can be abutted prior to the slit material being cut into pieces by the cutting blade.

6. The cutter of claim 4, wherein the length determining gage is slidable on the frame towards or away from the cutting blade to adjust the gage on the frame.

7. The cutter of claim 4, wherein the cutting blade is fixed on the frame such that the slit material is pulled against the fixed cutting blade to tear the slit material to length.

8. The cutter of claim 1, wherein both of the feed rollers have a sticky outer surface that is able to grip and pull the material.

9. A cutter for cutting pieces of flexible material from a roll of such material, which comprises:

(a) a frame having a generally enclosed end and an end that is upwardly open;

(b) a roll of flexible material rotatably carried on the open end of the frame;

(c) a plurality of slitting knives contained in the enclosed end of the frame beneath a top wall thereof and capable of being set at different spacings across the enclosed end of the frame, wherein the top wall of the frame overlies the knives and is sufficiently large and imperforate relative to the knives to substantially cover the to prevent the user from being able to reach through the top wall and contact the knives such that the user is protected by the top wall from contact with the slitting knives, the slitting knives being arranged longitudinally relative to the flexible material for slitting the material as it is pulled off from the roll thereof; and (d) means for adjusting the slitting knives from above the top wall of the frame.

10. The cutter of claim 9, wherein the top wall of the frame includes a slot, and wherein the slitting knives have upwardly extending handles which protrude upwardly through the slot to terminate in an upper end located above the top wall of the frame, the handles comprising the means for adjusting the slitting knives.

11. The cutter of claim 10, further including a scale on the top wall of the frame adjacent the slot for helping a user set the positions of the slitting knives across the enclosed end of the frame.

12. The cutter of claim 9, further including a cutting blade in the enclosed end of the frame for cutting the slit material to length after it has been slit by the slitting knives.

13. The cutter of claim 9, wherein the roll of flexible material is configured to drop into the open end of the frame from above, and further including a drop in tensioning roller that can be dropped down into the upwardly open end of the frame from above arranged between the flexible material roll and the enclosed end of the frame.

14. The cutter of claim 9, further including a set of feed rollers contained within the enclosed area of the frame for advancing the flexible material from the roll past the slitting knives, the feed rollers being operable from outside the enclosed area of the frame.

15. A cutter for cutting pieces of flexible material from a roll of flexible material, which comprises:

(a) a frame having means for rotatably supporting a roll of the flexible material on the frame such that the flexible material can be pulled off and unwound from the roll;

(b) a cutting area on the frame for carrying cutting elements comprising at least one slitting knife which is arranged longitudinally relative to the flexible material to slit the material lengthwise as the material is pulled past the at least one slitting knife;

(c) wherein the cutting area of the frame includes a wall with the at least one slitting knife being carried inside the cutting area such that the wall extends over and substantially covers the at least one slitting knife; and (d) further including a slot in the wall of the frame, and wherein each slitting knife has a handle protruding outwardly from the cutting area through the slot to allow the knife to be moved transversely and angularly within the cutting area.

16. The cutter of claim 15, wherein the slot has an edge which is configured relative to the knife and the handle thereof to provide a stop which limits the angular adjustment of the knife in a working position in which a tip of the knife is within the plane of the flexible material passing through the cutting area.

* * * * *